US009015971B2

(12) United States Patent
Peitzner-Lloret

(10) Patent No.: US 9,015,971 B2
(45) Date of Patent: Apr. 28, 2015

(54) IRONING AID AND DEVICE FOR SAFEKEEPING OF IRONING AIDS FOR SMOOTHING CLOSED TUBULAR ITEMS OF CLOTHING

(71) Applicant: Christian Peitzner-Lloret, Potsdam (DE)

(72) Inventor: Christian Peitzner-Lloret, Potsdam (DE)

( * ) Notice: Subject to any disclaimer, the term of this patent is extended or adjusted under 35 U.S.C. 154(b) by 0 days.

(21) Appl. No.: 13/789,830

(22) Filed: Mar. 8, 2013

(65) Prior Publication Data

US 2014/0250744 A1 Sep. 11, 2014

(51) Int. Cl.

| | |
|---|---|
| ***D06F 73/00*** | (2006.01) |
| ***D06F 85/00*** | (2006.01) |
| *A47G 25/76* | (2006.01) |

(52) U.S. Cl.
CPC ..... *D06F 85/00* (2013.01)

(58) Field of Classification Search
CPC ..... D06F 79/00; D06F 73/00; D06F 59/00; A47G 25/72; D05C 9/04
USPC ..... 38/69, 70, 102.1, 141; 112/103; 223/61–65; D11/206
See application file for complete search history.

(56) References Cited

U.S. PATENT DOCUMENTS

| | | | | | |
|---|---|---|---|---|---|
| 1,094,568 | A | * | 4/1914 | Hornich, Jr. | 70/459 |
| 1,102,029 | A | * | 6/1914 | Fitztgerald | 69/19.2 |
| 1,601,391 | A | * | 9/1926 | Holmquist | 223/65 |
| 1,828,472 | A | * | 10/1931 | Perez | 223/65 |
| 2,325,515 | A | * | 7/1943 | Hofgesang | 112/121 |
| 2,343,968 | A | * | 3/1944 | Fitzgerald | 69/19.2 |
| 2,642,209 | A | * | 6/1953 | Davis | 223/57 |
| 3,583,040 | A | * | 6/1971 | Terrell et al. | 24/707.8 |
| 6,390,001 | B1 | * | 5/2002 | Jones | 112/470.15 |

FOREIGN PATENT DOCUMENTS

| | | |
|---|---|---|
| DE | 102007054159 | 5/2009 |
| DE | 202009009634 | 10/2009 |
| FR | 647122 | 11/1928 |

* cited by examiner

*Primary Examiner* — Ismael Izaguirre
(74) *Attorney, Agent, or Firm* — Lisa V. Mueller; Michael Best & Friedrich LLP

(57) ABSTRACT

The invention refers to an ironing aid and a device for safekeeping of ironing aids for smoothing closed tubular items of clothing. The object was to propose a solution in the application of which a wire frame shaped ironing aid is an integral part of the aid for thermal smoothing of items of clothing and better handling is ensured. The object is achieved by their insertion in a profile bracket provided with an adhesion means. According to the invention, several ironing aids can be combined with a profile bracket, at least one of the ironing aids having a loop-like rounding at its end. Furthermore, one of the ironing aids can have a slight kink at a right angle to its planar extension (FIGS. 1/2).

6 Claims, 1 Drawing Sheet

Figure 1:
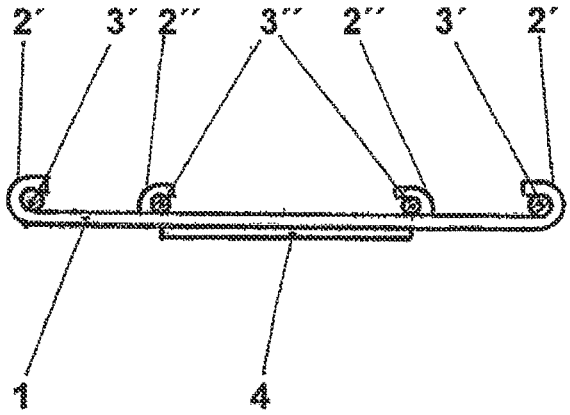

IRONING AID AND DEVICE FOR SAFEKEEPING OF IRONING AIDS FOR SMOOTHING CLOSED TUBULAR ITEMS OF CLOTHING

The invention refers to an ironing aid for insertion in a closed tubular item of clothing or tubular parts of an item of clothing for thermal smoothing thereof, generally known as ironing, and to a device for safekeeping of the same. Such a device called an ironing aid can also be used, with different dimensions, for tightening ties.

Devices for stretching a closed tubular item of clothing or its parts, such as sleeves and pockets, for ironing, are generally known.

They generally consist of a bow bent from an elastic wire which, with reference to its shape and independently from the wire strength, is nearly planar and formed in a plane so as to stretch, during ironing, the fabric by means of an inner integrated spring force and so as not to impede the planar removal of wrinkles, in particular under the addition of heat. By way of example, such a device is described in document DE 20 2009 009 634 U1. We also refer to DE 10 2007 054 159 A1. As a neck tie tightener, such a device is disclosed in FR 647 122 A.

It is generally a disadvantage that these ironing and tightening aids are not suitable for all types of use and that they are stored separately somewhere and are generally not available immediately if needed, in spite of their general advantages.

It is therefore an object of the invention to propose a solution including a wire frame shaped ironing aid as an integral part of the aid for thermal smoothing of items of clothing, and a better handling thereof.

The object is achieved by means of an ironing aid which, as is well-known, is formed from a commonly resilient bow with two legs, resilient toward each other and forming a substantially acute angle toward each other, which can also be U-shaped, in the untightened state; the resilient bow having such a spring force that the tubular item of clothing is stretched by the resilient bow, when it is inserted, from the inside, with the legs, however, forming such an angle that the parts of the respective leg before and behind the angle form an obtuse angle to each other. Furthermore, at least one of the legs resilient toward each other has a bend at its end so that it can enclose an insert. According to the invention, this bend is formed such as to comprise, with reference to a circular bend, more than 180 angular degrees.

This insert can display the trademark of the manufacturer or other similar information. The bend can also be used for suspending the ironing aid, if desired. At the same time, handling is safer due to the rounding.

For better safekeeping of the ironing aid, it can be combined with a planar piece in which holding lugs open on one side and facing each other with their openings are formed for the purpose of receiving the ironing aid. On the back of the planar piece, there is an adhesion means which can be a magnet, which is permanently glued or screwed onto the planar piece, if a respective antipole is provided on the base used for ironing. If this is not the case, the presence of a self-adhesive hook-and-loop fastener (e.g., VELCRO® strip) with its two functionally complementary parts may alternatively be used. As means for adhesion, furthermore a simply mechanical and effective clip can be used, such as a tablecloth clip.

Whether the ironing aid consists of v-shaped legs or of arc-shaped legs opposite to each other is irrelevant.

Between the holding lugs facing each other, an additional pair of holding lugs open on one side can be formed on the same face of the flat piece as the holding lugs open on one side and facing each other with their openings. This additional pair of holding lugs open on one side is useful if for ironing tubular items of clothing of low width, such as pockets of a shirt, the use of a narrower ironing aid is advantageous, or for a neck-tie tightener.

Figure 2:
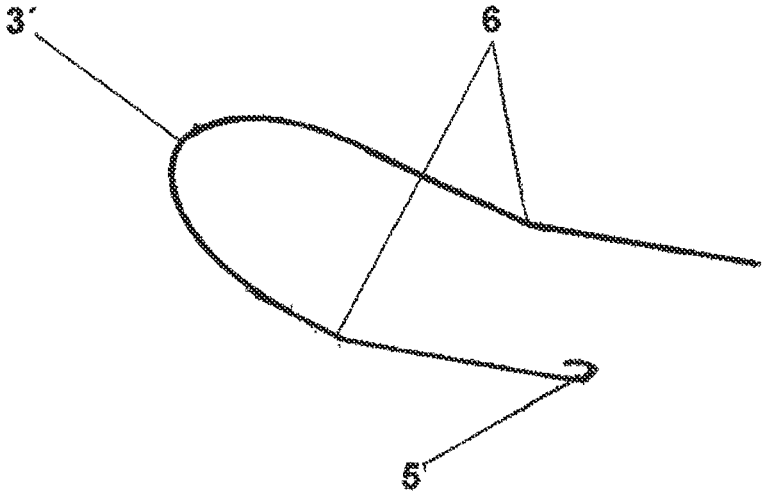

In the following, the invention is to be described in more detail by means of an example of embodiment. In the corresponding drawings, FIG. 1 shows a planar piece in lateral view with inserted ironing aids;

FIG. 2 shows an ironing aid slightly bent upwards in the 3$^{rd}$ dimension as it can be inserted, for example, in the exterior holding lugs open on one side and facing each other with their openings with respect to their position on the profile bracket.

On the exterior part of a planar piece 1 according to the invention, holding lugs 2' for receiving an ironing aid 3' are formed which are open on one side and face each other with their openings. Between them, preferably at the center, an additional pair of holding lugs 2" open on one side is formed by way of example for an additional ironing aid 3" for narrower tubular parts of an item of clothing. On the back of the planar piece 1, a magnet is fastened by gluing, by way of example, as an adhesion means 4, by means of which the planar piece 1 in its function as a safekeeping device for ironing aids and the like can be maintained on a suitable iron mounting of the ironing board or in a different suitable position. Alternatively, the magnet can be substituted by a piece of self-adhesive Velcro® strip, the adhesion-enabled part of the Velcro® strip engaging the opposite adhesive part so as to comprehensively ensure the function. The opposite adhesive part is fastened to a different suitable region.

On at least one of its free ends, the ironing aid 3' has such a bend 5 that a seal-like feature can lockingly be inserted into it. This bend has a circumference of at least 181 angular degrees. Furthermore, the ironing aid 3' has, with reference to its planar dimension, a kink 6 in the 3$^{rd}$ dimension so that the parts of the leg before the kink and the parts behind the kink form an obtuse angle. This embodiment is advantageous if, for instance, sleeves of an item of clothing are to be ironed.

REFERENCE SIGNS:

flat piece 1
holding lugs 2', 2"
ironing aid 3', 3"
adhesion means 4
bend 5
kink 6

The invention claimed is:

1. An ironing system comprising:

a planar piece;

holding lugs on a first face of the planar piece, each of the holding lugs open on one side, the open sides of the holding lugs facing each other;

an adhesion means on a second face of the planar piece that is opposite the first face of the planar piece;

an ironing aid removably received by the open sides of the holding lugs, the ironing aid for stretching a closed tubular item of clothing and including:

a resilient bow with two legs resilient toward each other having a substantially acute angle therebetween, the resilient bow including a spring force such that when the resilient bow is inserted into the tubular item of clothing, the spring force of the resilient bow stretches an inside of the tubular item of clothing;

wherein each of the legs includes a kink such that a part of the leg before the kink forms an obtuse angle with a part of the leg behind the kink; and wherein at least one of the legs includes a bend that removably secures an insert.

2. The ironing system according to claim 1, wherein the adhesion means is a magnet.

3. The ironing system according to claim 1, wherein the adhesion means is part of a hook-and-loop fastener that engages another adhesive part.

4. The ironing system according to claim 1, wherein the adhesion means is a mechanical clip.

5. The ironing system according to claim 1, further comprising at least one additional pair of holding lugs that are positioned between the holding lugs, each of the additional pair of holding lugs being open on one side for an additional ironing aid.

6. The ironing system according to claim 5, wherein the at least one additional pair of holding lugs are on the first face.

* * * * *